US012134005B2

(12) United States Patent
Kinney et al.

(10) Patent No.: US 12,134,005 B2
(45) **Date of Patent: *Nov. 5, 2024**

(54) EXERCISE BAR WITH DYNAMICALLY ROTATING HAND GRIPS

(71) Applicant: Resistance in Rotation, Peru, IN (US)

(72) Inventors: Joseph G. Kinney, Kokomo, IN (US); Ethan Kinney, Kokomo, IN (US)

(73) Assignee: Resistance in Rotation Corporation, Peru, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/053,211

(22) Filed: Nov. 7, 2022

(65) Prior Publication Data

US 2023/0086749 A1 Mar. 23, 2023

Related U.S. Application Data

(63) Continuation of application No. 17/188,654, filed on Mar. 1, 2021, now Pat. No. 11,504,572.

(51) Int. Cl.
*A63B 21/00* (2006.01)
*A63B 21/04* (2006.01)
(Continued)

(52) U.S. Cl.
CPC ..... *A63B 21/4049* (2015.10); *A63B 21/0435* (2013.01); *A63B 21/0724* (2013.01);
(Continued)

(58) Field of Classification Search
CPC ..... A63B 21/02; A63B 21/04–0407; A63B 21/0421; A63B 21/0435;
(Continued)

(56) References Cited

U.S. PATENT DOCUMENTS 4,461,473 A * 7/1984 Cole ..... A63B 21/0724 482/106
4,690,400 A * 9/1987 Metz ..... A63B 21/0724 482/106
(Continued)

FOREIGN PATENT DOCUMENTS

EP 1 718 372 B1 3/2011
WO 2016191867 A1 12/2016

*Primary Examiner* — Jennifer Robertson
(74) *Attorney, Agent, or Firm* — Maginot, Moore & Beck, LLP

(57) ABSTRACT

An exercise bar assembly includes a pair of rotating grip assemblies, each including a generally planar frame and a hand grip mounted within the frame for rotation within in the plane of the frame. The rotating grip assemblies are attachable to opposite ends of a center bar assembly along the longitudinal axis of the bar assembly. A plate bar assembly is attachable to each of the rotating grip assemblies opposite the center rod, with the plate bar assembly aligned with the longitudinal axis to form a weight lifting bar. A user-selectable elastic band is engageable between the pair of rotating grip assemblies along the longitudinal axis so that the elastic band resists rotation of each hand grip in each of the rotating grip assemblies. The rotating grip assemblies of the exercise bar assembly allow for the full range of motion of the bicep, and the elastic band creates a resistance exercise through the bicep's full range of motion.

15 Claims, 9 Drawing Sheets

(51) Int. Cl.
*A63B 21/072* (2006.01)
*A63B 23/035* (2006.01)
*A63B 23/14* (2006.01)

(52) U.S. Cl.
CPC .... *A63B 21/4035* (2015.10); *A63B 23/03541* (2013.01); *A63B 23/14* (2013.01)

(58) Field of Classification Search
CPC ..... A63B 21/055–0557; A63B 21/072–075; A63B 21/4049; A63B 23/14; A63B 2023/003
See application file for complete search history.

(56) References Cited

U.S. PATENT DOCUMENTS 5,211,616 A * 5/1993 Riley, Jr. ..... A63B 21/072 482/106
5,407,405 A 4/1995 Oren
7,238,147 B2 7/2007 Mills et al.
7,537,547 B1 5/2009 Hosick et al.
7,785,240 B2 8/2010 Stugart
7,862,486 B1 1/2011 Watson
8,702,574 B2 4/2014 Abranchess
8,845,500 B2 9/2014 Huang
9,375,601 B2 6/2016 Miller et al.
10,029,140 B2 7/2018 Douglass et al.
10,058,725 B2 8/2018 Lacaze
10,130,837 B2 * 11/2018 Grimaud ..... A63B 21/072
10,695,604 B2 6/2020 Porterfield
10,888,731 B2 1/2021 Olmstead et al.
11,504,572 B2 * 11/2022 Kinney ..... A63B 23/14
2005/0113221 A1 * 5/2005 Dovner ..... A63B 21/0552 482/121
2005/0202942 A1 9/2005 De Lano
2008/0176723 A1 7/2008 Johnson
2012/0094812 A1 * 4/2012 Smiley ..... A63B 21/05 482/128
2019/0275365 A1 9/2019 Bongelli

* cited by examiner

EXERCISE BAR WITH DYNAMICALLY ROTATING HAND GRIPS

PRIORITY CLAIM

This application is a continuation of application Ser. No. 17/188,654, filed on Mar. 1, 2021, which issued on Nov. 22, 2022, as U.S. Pat. No. 11,504,572.

BACKGROUND

The present disclosure pertains generally to an apparatus for use in the field of physical fitness. More particularly, the apparatus is an exercise bar with rotating had grips for use in weight training.

Strengthening the human upper body has long been a popular activity. Long ago, the activity was practiced using a dumbbell which consisted of a short bar equipped with a weight on each end, and formed with a grip portion in the middle of the bar. The weightlifter could grasp the grip portion and focus training on specific muscle groups. For instance, by standing with the dumbbell at the waist, and bending the elbow to "curl" or raise the wrist and forearm upwards, the biceps are strengthened. Also, by standing with the dumbbell behind the weightlifter's shoulder with the elbow bent, pushing the dumbbell upwards strengthens the triceps. By lying on his/her back and holding the dumbbell directly above the chest, pushing up towards the sky in what is called a "press" strengthens the triceps, pectoral, and other major muscle groups. Other strengthening exercises are well known in the art which may utilize one dumbbell or a pair of dumbbells—one in each hand.

In addition to the dumbbells which have been used for many years, so too has the barbell. A barbell consists of an elongated bar formed with a pair of grip portions in roughly the middle of the bar for grasping with the weightlifter's two hands, and equipped with a weight receiver on each end of the bar. By placing weights of different sizes on the weight receivers, a barbell of different weights could be constructed. Similar exercises to those completed with the dumbbells discussed above can also be performed with a barbell. For instance, by standing up with the barbell at the weightlifter's waist and bending the elbows to raise the barbells upwards, a "curl" is performed strengthening the forearms and biceps. Similarly, with the weightlifter lying down and pushing the barbell upwards from the chest, a "press" is performed thereby strengthening the triceps and pectorals.

Because the weights placed on a barbell can be very heavy, it is important to have a proper grip on the grip portion of the barbell. During exercise routines, it is also important that the weightlifter's grip be consistent with the exercise being performed. For instance, the grip in a curl exercise may be very different from an exercise in a press exercise.

However, the grip portion of the conventional barbell is fixed as part of a rigid steel bar, and often perfectly linear. As a result, even though the grip portion may be in a proper position for a weightlifter at the start of the exercise, it is likely that the fixed grip portion of the barbell will be in a non-optimal position during at least a portion of the exercise. For instance, when performing a curl exercise with a barbell having a linear bar and fixed grip portion, the weight lifter's hands are in an acceptable position at the start of the exercise. However, as the barbell is raised upwards, the wrist has a tendency to rotate as the elbow bends upwards. Because the grip portion of the barbell is fixed, there is a significant amount of strain placed on the weightlifter's wrist and forearm. This strain can result in injury caused by excessive torsion on the wrist and forearm, including pulled muscles, strained ligaments, and other injuries requiring orthopedic treatment.

Several attempts to overcome the shortcomings of a straight-bar barbell follow the approach of the supinating barbell disclosed in U.S. Pat. No. 4,690,400, which issued on Sep. 1, 1987 to Metz. The Metz barbell incorporates a pair of circular housings mounted to the bar which supports hand grips mounted for rotation within the housings. In many such devices, the hand grips can freely rotate to accommodate the change in wrist position as the barbell is raised and lowered. Other devices, such as the Metz barbell incorporate a friction mechanism between the grip and the housing to adjust the resistance to rotation of the hand grips from no resistance to a locked engagement. The same friction resistance concept has been incorporated into wrist and forearm exercise devices, such as the rotational exerciser shown in U.S. Pat. No. 8,845,500, which issued on Sep. 30, 2014.

SUMMARY OF THE DISCLOSURE

An exercise bar assembly is provided that comprises a pair of rotating grip assemblies, each grip assembly including a generally planar frame and a hand grip mounted within the frame for rotation within in the plane of the frame. A center bar assembly defining a longitudinal axis and opposite ends along the longitudinal axis, is fixed at its opposite ends to the frame of the rotating grip assemblies along the longitudinal axis. A pair of plate bar assemblies are also fixed to the frame of the rotating grip assemblies along the longitudinal axis.

In one feature of the disclosure, an elastic element is engageable between the pair of rotating grip assemblies along the longitudinal axis. The elastic element can comprise an elongated elastic band having a spring constant for resisting rotation of the hand grip in each of the rotating grip assemblies. Each of the pair of rotating grip assemblies include a ring plate defining a circumference and rotatably mounted in the frame for rotation within the plane of the frame. The ring plate carries the hand grip and can be rotated at least between a position in which the hand grip is perpendicular to the longitudinal axis and a position in which the hand grip is aligned with the longitudinal axis.

In a further feature of the disclosure, a plurality of bearing posts project perpendicularly from the ring plate, with one bearing post arranged on the ring plate to be aligned with the longitudinal axis when the hand grip is perpendicular to the longitudinal axis. Another bearing post is arranged 180 degrees opposite the one bearing post. The other bearing posts are spaced 45 degrees apart from the one bearing post around the circumference of the ring plate. The elongated band includes a collar at each end thereof that is configured to be mounted on any of the bearing posts of each of the pair of rotating grip assemblies. When the elongated band is mounted on the one bearing post, for instance, manual rotation of the hand grips, and thereby rotation of the rotating grips assemblies, causes the elastic band to contact successive ones of the bearing posts in the direction of rotation of the hand grip.

In a common weight training exercise, the curl, rotation of the wrist is done by the forearm and assisted by bicep until arm has bent to 90 degrees. During further curl movement after reaching 90 degrees, the bicep alone controls the forearm. When the bicep contracts it pulls the forearm up and naturally rotates it outward naturally. If the wrist is not allowed to rotate the bicep cannot contract fully. The rotating grip assemblies of the exercise bar assembly disclosed herein allow for the full range of motion of the bicep, and the elastic band creates a resistance exercise through the bicep's full range of motion.

DETAILED DESCRIPTION

Figure 1:
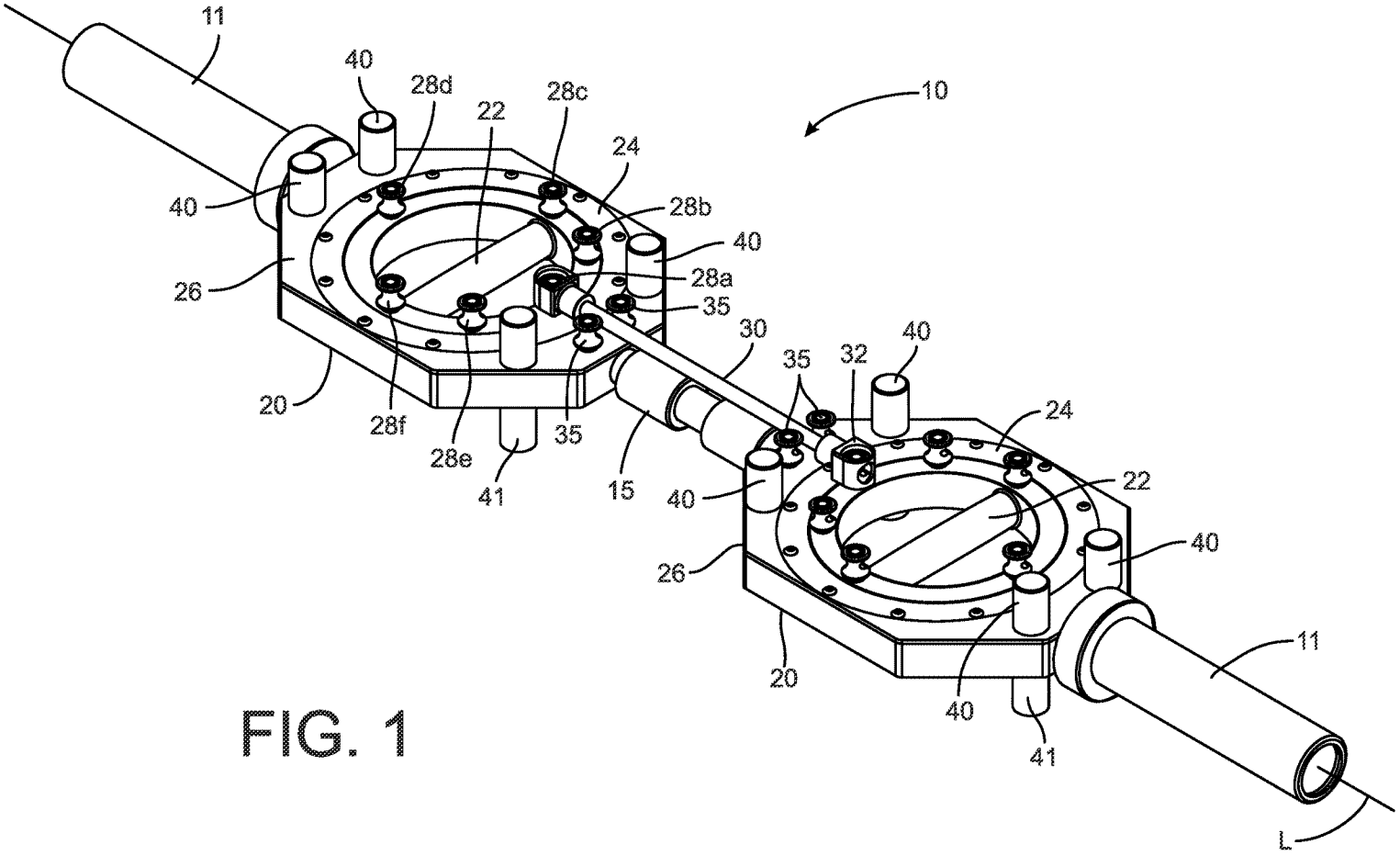
FIG. 1 is a top perspective view of an exercise bar assembly according to one aspect of the present disclosure.

For the purposes of promoting an understanding of the principles of the disclosure, reference will now be made to the embodiments illustrated in the drawings and described in the following written specification. It is understood that no limitation to the scope of the disclosure is thereby intended. It is further understood that the present disclosure includes any alterations and modifications to the illustrated embodiments and includes further applications of the principles disclosed herein as would normally occur to one skilled in the art to which this disclosure pertains.

An exercise bar assembly 10 shown in FIG. 1 includes a pair of plate bar assemblies 11 that can be weighted and/or configure to receive conventional weight plates. The length of the plate bar assemblies 11 depends on the intended use of the bar assembly, and in particular the amount of weight expected to be carried by the bar assembly. A length of 8-14 inches is typical. Each plate bar assembly is fastened to a rotating mount assembly 24, and in particular to a rigid generally planar frame 26 of the mount. The frames of the two rotating mount assemblies 26 are connected to each other by a center bar assembly 15. The combination of the plate bar assemblies 11, center bar assembly 15 and the frames 26 form the barbell. Thus, the assembly of these components must be strong enough to support the weight carried by the plate bar assemblies 11 during use of the exercise bar assembly 10. The center bar assembly 15 has a length that is sized to locate the rotating mount assemblies at an ideal location for the person to comfortably lift the bar assembly during a workout. Nominally, the person will grasp a conventional barbell with the hands roughly shoulder-width apart. Some weight-lifting exercises require the grip positions to be moved inboard or outboard. As described herein, the present disclosure contemplates that the center bar assembly can be provided in different lengths to provide different grip positions.

The rotating assemblies mounts 24 support hand grips 22 for rotation in the plane of the frames 26. The hand grips 22 are conventionally sized to be comfortably grasped by the user. As described in more detail herein, a bearing assembly supports each of hand grips within its corresponding frame and permits smooth rotation of the grips relative to the frame. Each rotating mount assembly 24 includes a plurality of bearing posts 28*a*-28*f* projecting from one side of the mount, as shown in FIG. 1. In one important feature of the bar assembly 10, an elastic band 30 includes a mounting collar 32 on each end that is adapted to be mounted on a bearing post on the two rotating mount assemblies 24. The elastic band spans between the two rotating grip assemblies 20 over the center bar assembly 15. As can be readily appreciated, the elastic band 30 provides elastic resistance to rotation of the hand grips 22 relative to the corresponding frames 26. The elastic band 30 can be in several forms, such as a resistance work-out band or a bungee cord, with a predetermined resistance against elongation or a predetermined spring constant. The band must be capable of repeated extension and elastic retraction without failure and preferably incorporates an outer surface capable of low-friction engagement with the bearing posts, as described herein. In one embodiment, shown in FIG. 9, the bearing posts include a spool 29*a* rotatably mounted on a post 29*b*, that is in turn mounted to the frame by a threaded post 29*c*. The spool 29*a* defines a recess to receive the elastic band, as described below. Since the elastic band is intended to provide resistance against rotation of the hand grips, the rated force of the band is less than for a conventional work-out resistance band. In one specific embodiment, the elastic band can have a spring constant to achieve rated force of ten pounds at a maximum elongation of about 250%.

Figure 2:
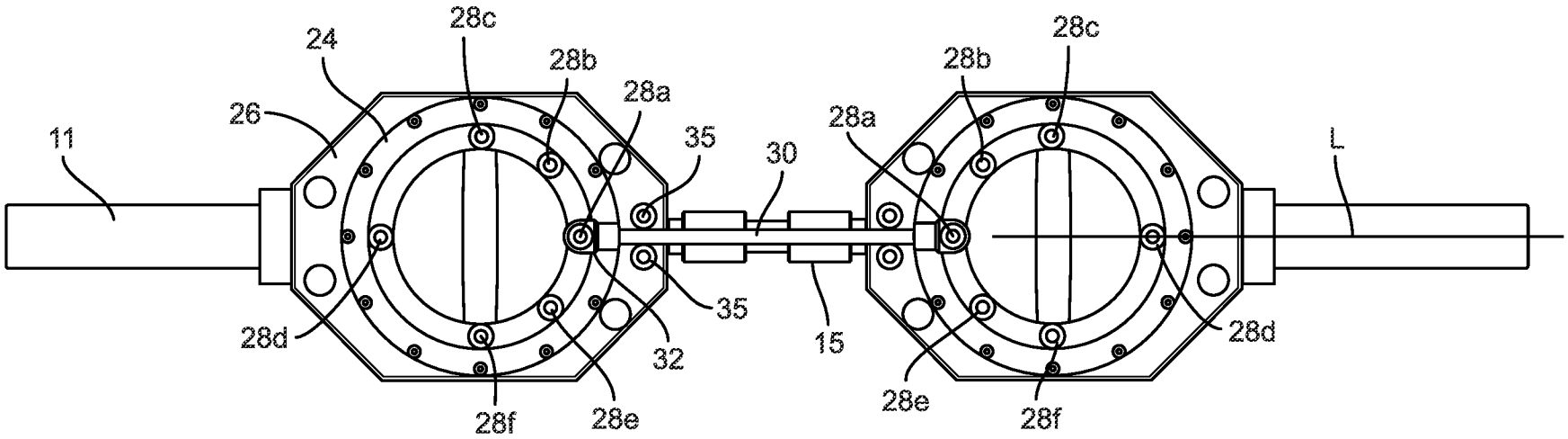
FIG. 2 is a top view of the exercise bar assembly shown in FIG. 1.
Figure 3:
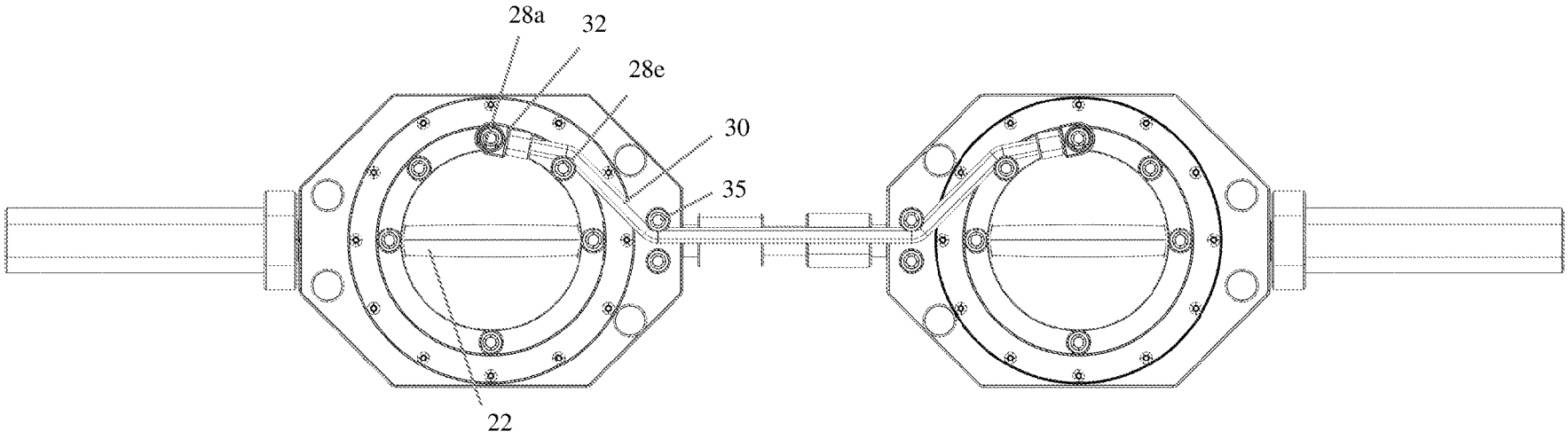
FIG. 3 is a top view of the exercise bar assembly shown in FIG. 1, shown with the rotating grip assemblies rotated from a first starting position.
Figure 9:
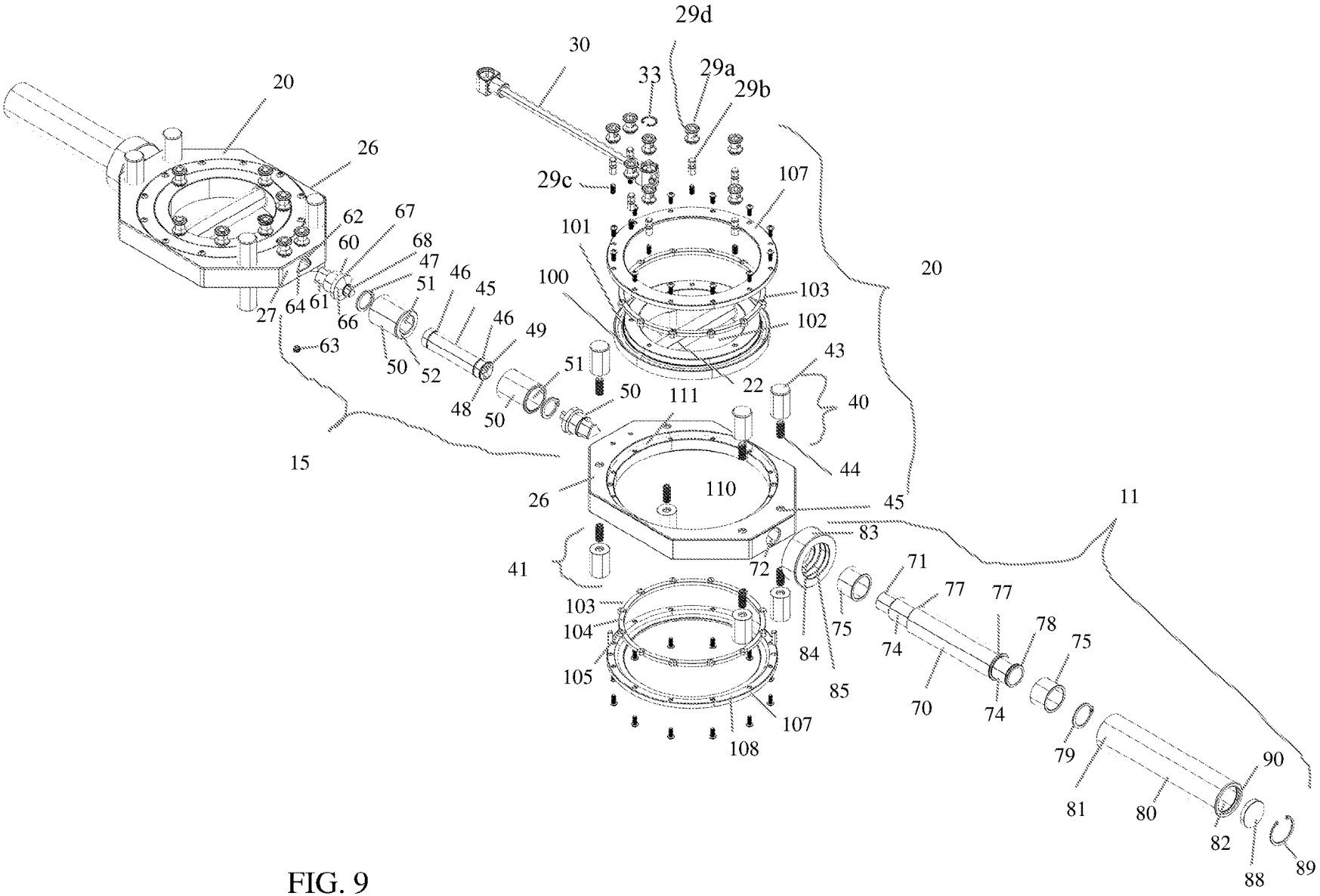
FIG. 9 is an exploded perspective view of the exercise bar assembly shown in FIG. 1.

In a baseline position, the hand grips are oriented perpendicular to the longitudinal axis L along the length of the bar assembly, as depicted in FIG. 1. The mounting collar 32 of the elastic band 30 is mounted on the baseline bearing post 28*a*, as shown in FIG. 2, and held in place by a snap ring 33 (FIG. 9). In this baseline position, the elastic band is at its neutral, unstretched length. When the two hand grips are rotated 90° from this baseline position, or first starting position, as shown in FIG. 3, the elastic band is stretched because the mounting collars 32 at the end of the band are carried with the bearing post 28*a* as the respective rotating mount assemblies 24 are rotated. As the hand grips are rotated, the elastic band first engages one of the fixed bearing posts 35 and then engages the next successive bearing post 28*e* for a counter-clockwise rotation of the left-hand grip and a clockwise rotation of the right-hand grip. It can be appreciated that when executing a curl, the wrists have a tendency to rotate outward as the bar assembly is lifted. The length of the elastic band increases as the position of the bearing posts on which mounting collars are engaged move circumferentially with the rotation of each rotating mount assembly 24. The change in length is roughly equal to ¼ the circumference of the rotating mount assembly for a 90° rotation of one the hand grips, or double that value for rotation of both hand grips. Thus, in the illustrated embodiment of FIG. 3, the elastic band is elongated about 150%.

Figure 4:
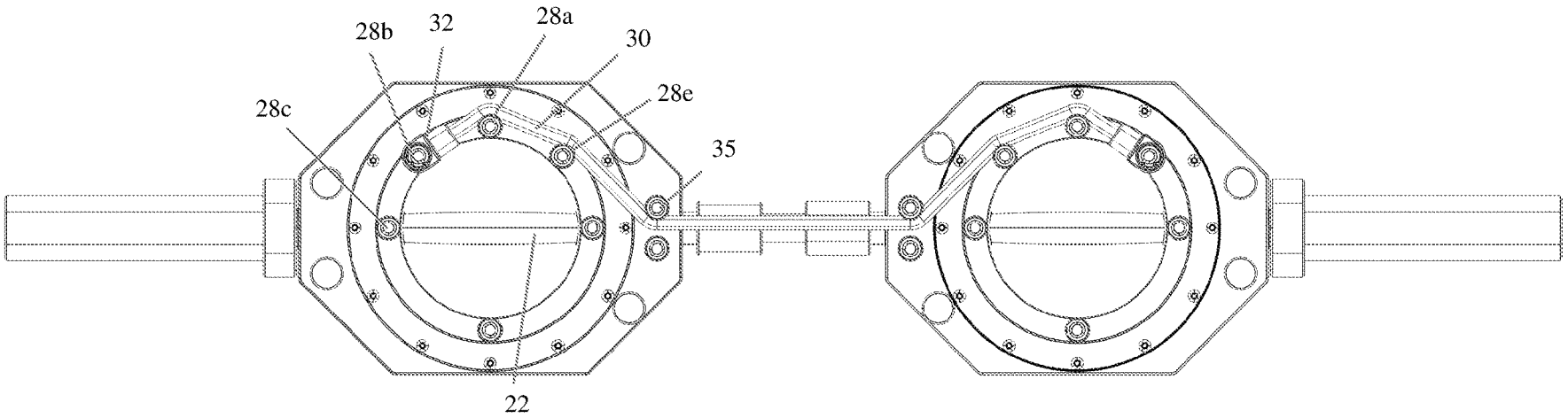
FIG. 4 is a top view of the exercise bar assembly shown in FIG. 1, shown with the rotating grip assemblies rotated from a second starting position.
Figure 5:
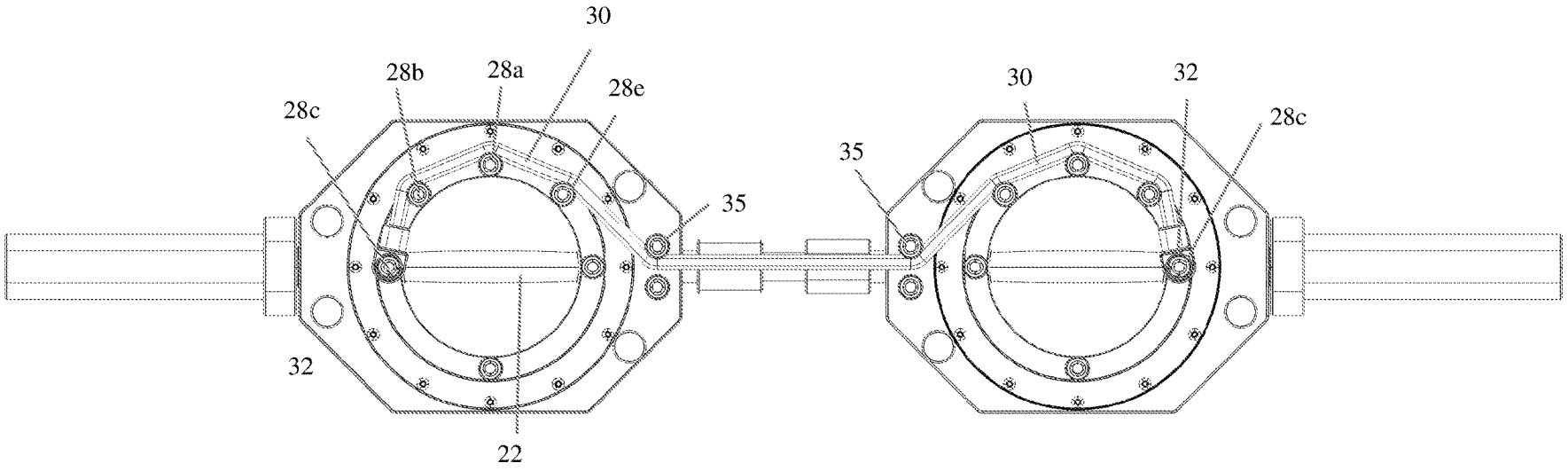
FIG. 5 is a top view of the exercise bar assembly shown in FIG. 1, shown with the rotating grip assemblies rotated from a third starting position.
Figure 6:
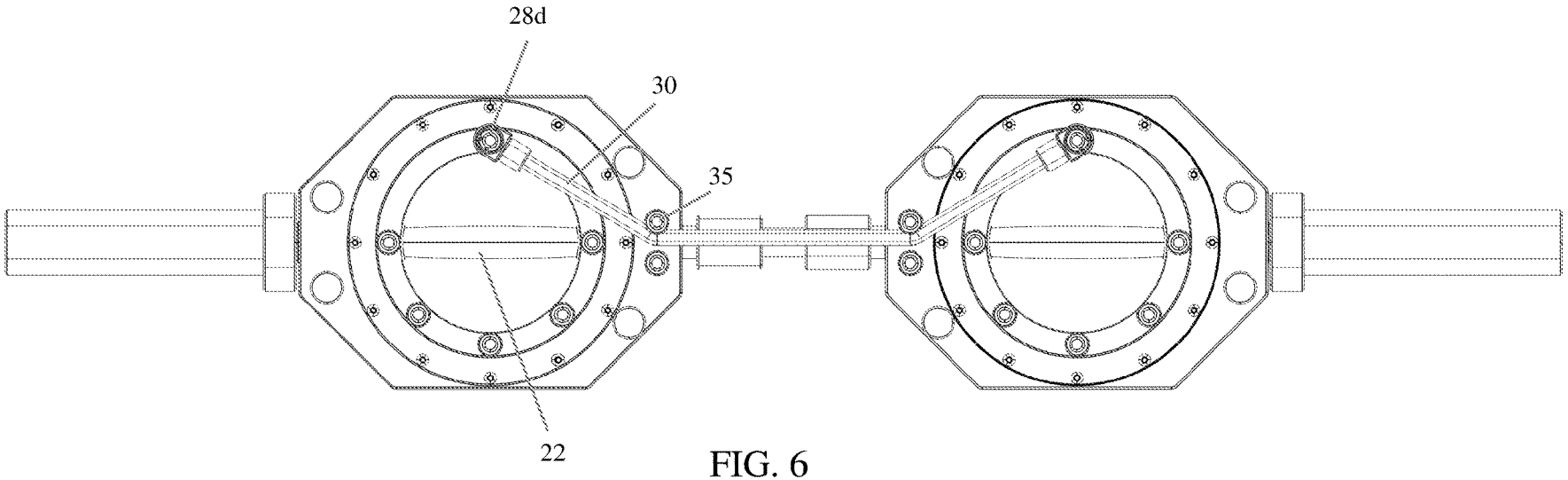
FIG. 6 is a top view of the exercise bar assembly shown in FIG. 1, shown with the rotating grip assemblies rotated from a fourth starting position.
Figure 7:
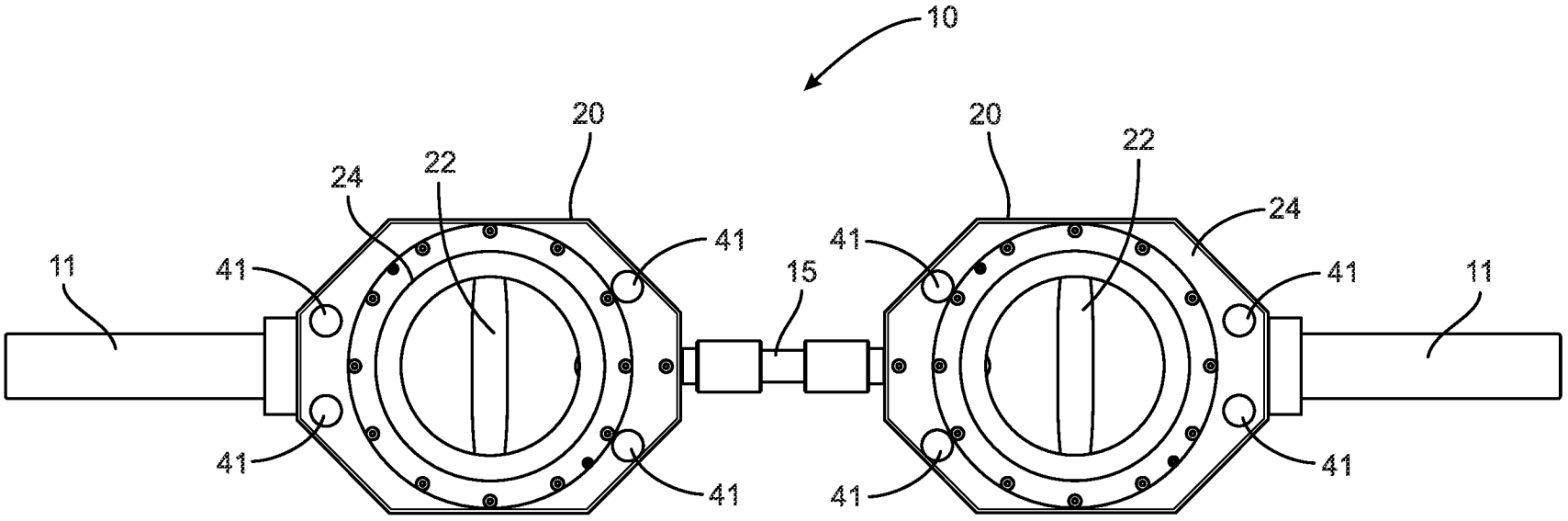
FIG. 7 is a bottom view of the exercise bar assembly shown in FIG. 1.

As shown in FIG. 2, each rotating mount assembly 24 includes a plurality of bearing posts distributed around the circumference of the mount. In the illustrated embodiment, seven bearing posts are provided, with posts 28*a* and 28*d* oriented along the longitudinal axis L of the bar assembly, and 180° opposite each other. Two bearing posts 28*b*, 28*c* are spaced at 45° intervals in the counter-clockwise direction on the left-side rotating mount assembly from the baseline post 28*a* (or clockwise on the right-side mount). Two bearing posts 28*e* and 28*f* are spaced at 45° intervals in the clockwise direction on the left-side rotating mount assembly from the baseline post 28 (or counter-clockwise on the right-side mount). These additional mounts engage the elastic band 30 as the rotating mount assemblies are rotated so that the band is stretched across the posts, as shown in FIG. 3. In addition to this feature, the additional mounts provide a different mounting point, or starting point, for the collar 32 of the elastic band 30, which allows the user to vary the resistance force at the 90° rotation of the and grips 22. Thus, as shown in FIG. 4, the mounting collar 32 of the elastic band 30 can be mounted on the bearing mount 28*b*, instead of the baseline bearing mount 28*a*. With the elastic band anchored at this second starting location, the 90° rotation of the hand grip stretches the band 30 essentially 45° farther around the circumference of the rotating mount assembly than when starting at the baseline position 28*a*. With the starting position of the elastic band on the bearing mounts 28*b*, the 90° rotation of the hand grip elongated the elastic band by about 200%. The full elongation of the elastic band (about 250%) can be achieved if the collars 32 of the elastic band are mounted on the bearing mounts 28*c* at the third starting location shown in FIG. 5. On the other hand, the minimal elongation is achieved by placing the band mounting collars on the bearing posts 28*d*, as shown in FIG. 6. In this fourth starting position, the 90° rotation of the hand grip 22 does not draw the elastic band 30 across any other bearing mount, as in the previous positions. The elongation of the band is less than the elongation shown in FIG. 3 because the band is not drawn across the bearing post 28*f*. The band is elongated about 140% when mounted to posts 28*d*.

It should be understood that the exercise bar assembly 10 of the present disclosure can be used to perform the full range of arm exercises and lifts. The rotating mount assembly 24 for the hand grips 22 allows the grips to rotate as the arm is lifted or lowered, in accordance with the natural physiology of the wrists and forearms. The incorporation of the elastic band 30 between the rotating mount assemblies adds resistance to the natural forearm rotation, which in turn adds another level to the arm exercise. The user can adjust the amount of resistance to rotation by mounting the elastic band on different bearing posts, thereby varying the elongation from 140% to 250%. The user can also adjust the amount of resistance by selecting from a plurality of elastic bands having different spring constants or rated forces. The elastic band 30 can be easily removed and replaced with a different elastic band.

The bar assembly 10 also allows the user to rotate the hand grips inward—i.e., clockwise with the left hand and counter-clockwise with the right hand—to provide a negative bicep workout. For this type of workout, the elastic band 30 is mounted on the posts 28*f* so that the grips 22 are parallel to the bar axis L. Rotation of the hand grips draws the elastic band down across the lower fixed post 35 and across the bearing post 28*e* until the hand grip is in the perpendicular position. The elastic band is elongated as the left rotating mount 24 rotates clockwise and the right mount rotates counterclockwise.

Figure 8:
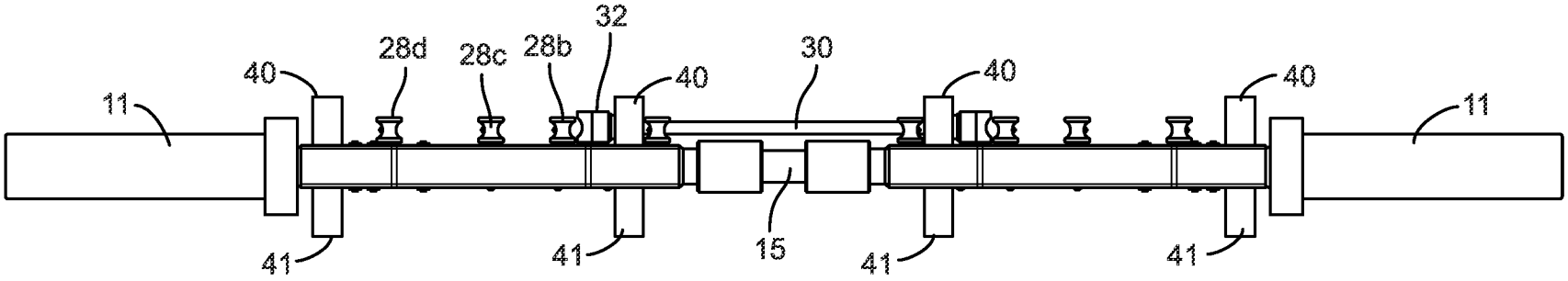
FIG. 8 is a side view of the exercise bar assembly shown in FIG. 1.

Further features of the exercise bar assembly 10 are shown in FIG. 1 and FIGS. 7-9. The rotating grip assemblies 20 include a plurality of support posts 40 projecting from the top side of the frame 26 of each assembly, and a like plurality of posts 41 projecting from the bottom side of the frames, as best seen in FIG. 8. The support posts are sufficiently tall for the bar assembly to be supported on a surface, such as the floor, with clearance for the plate bar assemblies 11 and the bearing posts 22. The support posts 40, 41 allow a user to perform push-ups with the exercise bar assembly 10 sitting on the floor. In this respect, the bar assembly 10 works like a push-up disc known in the art. However, the elastic band 30 between rotating mount assemblies adds a feature not found in the conventional push-up discs. In one embodiment, the support posts can include a stud 43 into which is threaded a mounting screw 44. The mounting screw is in turn threaded into a bore 45 defined in the frame 26 of the rotating mount assembly 24. This allows the support posts 40, 41 to be removed as desired. The stud can have a hex configuration for engagement with a wrench or can include some other feature to be engaged by a driving tool.

In one embodiment, the exercise bar assembly 10 allows the rotating grip assemblies 20 to be separated by different distances to provide different grip locations. As mentioned above, for a conventional bicep curl, the exercise bar is optimally gripped at shoulder width. Of course, shoulder width varies among users, so while a grip spacing of 24 inches may be comfortable for many users, shorter or taller users may require different grip spacing. In addition, different exercises require different grip locations, inside and outside shoulder-width, to work different muscle groups. Thus, in one aspect of the present disclosure, the exercise bar assembly 10 can be provided with an adjustable or modifiable center bar assembly 15 spanning the space between the two rotating handle assemblies 20. In particular, the center bar assembly 15 includes a center bar 45 that can be provided in different lengths. In particular, the user can select from several center bars 45 of different lengths to find a suitable grip width.

Each center bar 45 is configured to be removed from the center bar assembly 15 for ready replacement. Thus, in one embodiment, the center bar 45 includes snap ring grooves 46 adjacent the opposite ends of the bar, as shown in FIG. 9. The grooves are configured to receive a snap ring 47. The assembly further includes a pair of collars 50 arranged at the opposite ends of the center bar 45, each defining a bore 51 through which the center bar extends. The end of the collars facing the center bar define a circumferential flange 52 that is sized to trap the snap rings 47 within the collars, thereby locking the collars 50 to the center bar 45. It can be appreciated that the collars and center bar can be assembled by first introducing one end of the center bar 45 into the bore 51 of one collar with the snap ring groove 46 accessible at the opposite end of the collar for engagement of the snap ring 47. Once the snap ring is engaged, the first collar can be slid to the end of the rod so that the second collar can be slid onto the second end of the rod. The second end is accessible outside the bore 51 of the second collar for engagement of the snap ring 47 with the groove at the second end of the rod, thereby fixing the second collar to the rod.

In can be appreciated that this intermediate assembly of the center rod 45 and the two collars 50 is a loose assembly since the collars are free to slide along the rod, although they are prevented from becoming disengaged by the snap rings 47. The center bar assembly 15 thus includes a mounting element 60 that is configured to fix the intermediate assembly to the frames of the respective rotating grip assemblies 20, while simultaneously pushing the snap rings 47 against the end flanges 52 of the two collars 50. The mounting element 60 includes an outboard stud 61 that is configured for a close-fit with a bore 62 defined in an end face 27 of the frame 26. In one embodiment, the outboard stud 61 and bore 62 define complementary shapes, such as the triangular shape shown in FIG. 9. The stud 61 is pressed into the bore 62 and held in place by a set screw 63 threaded through a threaded bore 64 that intersects the bore 62. The element 60 further includes a conical end face 66 that is configured to engage a complementary conical surface 48 in each end of the center rod 45. An inboard stud 68 projects from the conical end face 66 and is configured to be seated in a complementary shaped bore 49 in each end of the rod 45. The inboard stud 68 and complementary bore 49 can have a non-circular shape, such as the triangular shape shown in FIG. 9. It can thus be appreciated that the center bar 45 is fixed against rotation along its axis by way of the non-circular interfaces between the studs 61, 68 and their respective complementary bores 62, 49.

The assembly is clamped together by a threaded portion 67 of the component 60 that threads into a threaded end (not shown) of the bore 51 of the collar 50. The collar is not constrained against rotation, so it can be rotated to thread itself onto the threaded portion 67 of the rotationally fixed component 60. The exterior of the collar 60 can be configured to receive a tool, such as a wrench, or can include knurling or some other grip enhancing feature that permits manual tightening. The threads can be self-locking threads so that the components of the center bar assembly 15 remains rigidly coupled during use of the bar assembly 10. As the collar is threaded onto the threaded portion 67 of the mounting element 60 the inboard stud 68 engages the complementary opening 49 in the center bar 45 and the conical end face 68 engages the conical surface 48 of the bore. Continued rotation of the collars 50 gradually clamps the center bar 45 between the mounting elements 60, forming a rigid connection between the center bar and the two rotating grip assemblies 20.

It can be appreciated that this assembly 15 allows a user to easily replace the center bar 45 with a bar of different length in order to adjust the grip width for the exercise bar assembly 10. In one embodiment, the assembly 15 is provided to the user as a completed assembly with the mounting elements 60 at the ends of the center bar assembly free to be placed with the respective openings 62 in the left and right frames 26. Additional assemblies with longer center bars 45 can be provided to the user in a completed assembly. Alternatively, the user can be permitted to disassemble the center bar assembly 15, by first unthreading the two collars 50 from the threaded portion 67 of the mounting elements 60 so that the center bar and collars can be removed. One collar is slid down the center bar toward the opposite end to expose one of the snap rings 47 for removal. The associated collar is removed and the other collar slid down the center bar to expose the other snap ring for removal. The process can be reversed to add a new center bar 45 to the assembly 15.

The plate bar assemblies are also configured to be removed from the exercise bar assembly 10. It can be appreciated that the plate bar assemblies 11 and the center bar assembly 15 can be removed from the rotating grip assemblies 20 to break down the entire exercise bar assembly 10 for storage or transport. In addition, removing the plate bar assemblies can essentially convert the remainder of the exercise bar assembly 10 to a wrist/forearm exercise apparatus rather than a weight lifting apparatus.

The plate bar assembly 11 includes an inner bar 70 with a threaded end 71 for engagement with a threaded bore 72 in the frame 26 of each rotating grip assembly 20. The inner bar includes bearing seats 74 at the opposite ends of the bar to receive bearings 75. The bearings abut a shoulder 77 of the inner bar, with one bearing held in place between the shoulder and an end face 84 of an anchor cap 83, and the other bearing held in place against the shoulder by a snap ring 79 fixed in a snap ring groove 78 at the outboard end of the bar 70. It can be understood that the anchor cap 83 is trapped between the inner bar 70 and the face of the frame 26 when the threaded end 71 of the inner bar 70 is threaded into the bore 72.

The plate bar assembly 11 further includes an outer bar 80 having a bore 82 sized to fit over the inner bar, and in particular to have a close running fit with the outer surfaces of the bearings 75. The outer bar 80 includes a threaded end 81 that is configured to engage internal threads 85 of the anchor cap 83. The outer bar 80 can be fixed to the inner bar 70 by way of the threaded engagement with the anchor cap 83, with the anchor cap in turn fixed to the frame 26 by the threaded engagement of the inner bar 70 with the frame. A cover plate 88 covers the bore 82 and is held in place by a snap ring placed within groove 90 at the end of the outer bar.

The rotating grip assemblies 20 include a ring plate 100 that includes the handle 22 spanning a center opening 102 of the plate. The center opening 102 is sized so that a user can easily grasp the grip 22 with sufficient clearance to avoid contacting the ring plate 100. In one embodiment, the center opening can have a diameter of 6-8 inches. The ring plate is configured to be received for free rotation within the circular opening 110 in the frame 26. The upper and lower perimeter of the ring plate define a bearing channel 101. The assembly further includes upper and lower bearing assemblies 103 that include a plurality of ball or roller bearings 105 contained within a circular cage 104. The ball bearings are configured for rolling movement within the bearing channels 101 on the top and bottom faces of the ring plate. The ring plate and bearing assemblies 103 are held in place within the opening 110 of the frame by outer race plates 107. The outer race plates each define a bearing channel 108 to receive the ball bearings 105 of the bearing assemblies. The outer race plates 107 are fastened to a mounting flange on each side of the frame 26, such as by bolts or other conventional fasteners. The ring plate 100 and the two bearing assemblies 103 are thus sandwiched between the two outer race plates 107 so that the ring plate, and therefore the hand grip 22, is free to rotate within the frame. It can be appreciated that the bearing posts **28*a*-28*f* are mounted to the upper face of the ring plate 100 of each rotating mount 24**

The present disclosure should be considered as illustrative and not restrictive in character. It is understood that only certain embodiments have been presented and that all changes, modifications and further applications that come within the spirit of the disclosure are desired to be protected. For instance, the center bar assembly 15 can be replaced with a single center bar that integrates the mounting element 60 into the ends of the bar. Alternatively, the center bar assembly can be replaced with a single bar that is integral with the two frames 26. Likewise, the plate bar assemblies 11 can each constitute a single bar with the threaded end 71 for engagement with the threaded bore 72 in each frame. Alternatively, the plate bar assemblies can be replaced with a single bar that is integral with the two frames.

It is further contemplated that other bearing arrangements can be implemented to support the rotating mount 24 within the frame 26 of the rotating grip assemblies 20. For instance, the outer rim of the ring plate 100 can be provided with bearing elements for engaging the inner circumference of the frame 26 at the opening 110. Alternatively, the outer rim of the ring plate and the inner circumference of the frame can be configured for sliding surface-to-surface contact, by providing the surfaces with a low friction material, such as TEFLON®. The bearing channel 101 of the outer race plates 107 can also be configured for sliding surface-to-surface contact with the top and bottom faces of the ring plate 100.

What is claimed is:

1. An exercise bar assembly, comprising:

a pair of rotating grip assemblies, each including a generally planar frame and a hand grip mounted within the frame for rotation within the plane of the frame, each hand grip including a post extending perpendicular to the plane of the frame;

a center bar assembly defining a longitudinal axis and opposite ends along the longitudinal axis, each of the opposite ends fixed to said frame of a corresponding one of the rotating grip assemblies along the longitudinal axis; and an elongated elastic element having opposite ends, each of said opposite ends configured to be removably mounted on a post of a corresponding one of said pair of rotating grip assemblies with said elastic element extending along said longitudinal axis, said elastic element resisting rotation of said hand grip in each of the rotating grip assemblies, wherein each of said rotating grip assemblies includes a fixed bearing post, separate from said post, projecting perpendicularly from said frame and arranged on said frame to contact said elastic element upon rotation of said hand grip.

2. The exercise bar assembly of claim 1, wherein:

each of said pair of rotating grip assemblies include;

a ring plate rotatably mounted in said frame for rotation within the plane of the frame, said ring plate carrying said hand grip, wherein said ring plate can be rotated at least between a position in which said hand grip is perpendicular to said longitudinal axis and a position in which said hand grip is aligned with said longitudinal axis; and said post is a bearing post projecting perpendicularly from said ring plate, wherein said bearing post is arranged on said ring plate to be aligned with said longitudinal axis when said hand grip is perpendicular to said longitudinal axis.

3. The exercise bar assembly of claim 1, further comprising a plurality of support posts projecting perpendicularly from said frame of each of said rotating grip assemblies, said support posts configured to support said exercise bar assembly on a surface with said planar frame of each rotating grip assembly generally parallel to the surface.

4. The exercise bar assembly of claim 1, further comprising a pair of plate bar assemblies fixed to said frame of a corresponding one of said rotating grip assemblies along said longitudinal axis, wherein each of said plate bar assemblies is configured to receive and support a number of weight plates.

5. The exercise bar assembly of claim 1, wherein said post and said fixed bearing post each include a spool rotatably mounted on said corresponding hand grip and said frame.

6. The exercise bar assembly of claim 1, wherein said center bar assembly is removably fixed to said frame of said rotating grip assemblies.

7. The exercise bar assembly of claim 1, wherein said elongated elastic element is selectable from a plurality of elastic elements having different spring constants.

8. An exercise bar assembly comprising:

a pair of rotating grip assemblies, each including;

a generally planar frame defining a plane;

a ring plate defining a circumference and rotatably mounted in said frame for rotation within the plane of the frame, said ring plate carrying a hand grip, wherein said ring plate can be rotated at least ninety degrees (90°) within the frame; and two or more bearing posts projecting perpendicularly from said ring plate and spaced angularly apart from each other around the circumference of said ring plate;

an elongated center bar assembly having opposite ends, each of said opposite ends fixed to the frame of a corresponding one of said rotating grip assemblies; and an elongated elastic element having opposite ends, each of said opposite ends mounted on one bearing post of said two or more bearing posts of a corresponding one of said pair of rotating grip assemblies with said elastic element extending between said one bearing post of said pair of rotating grip assemblies, said elastic element resisting rotation of said hand grip in each of the rotating grip assemblies, wherein, for each of said pair of rotating grip assemblies, the bearing posts other than said one bearing post are arranged on said ring plate to be successively engaged by said elongated elastic element mounted on said one bearing post when said ring plate of each of said rotating grip assemblies is rotated.

9. The exercise bar assembly of claim 8, wherein said elongated elastic element is an elongated band with a collar at each of said opposite ends, said collar configured to be mounted on said one bearing post of each of said pair of rotating grip assemblies.

10. The exercise bar assembly of claim 8, wherein each of said rotating grip assemblies includes a fixed bearing post projecting perpendicularly from said frame and arranged on said frame to contact said elongated elastic element upon rotation of said ring plate with said hand grip.

11. The exercise bar assembly of claim 8, wherein said two or more bearing posts are spaced apart at 45-degree intervals around the circumference of said ring plate.

12. The exercise bar assembly of claim 8, wherein said two or more bearing posts include two bearing posts spaced apart from said one bearing post at 45-degree intervals clockwise around the circumference of said ring plate, and two bearing posts spaced apart from said one bearing post at 45-degree intervals counter-clockwise around the circumference of said ring plate.

13. The exercise bar assembly of claim 8, wherein said bearing posts other than said one bearing post are arranged on said ring plate of each of said rotating grip assemblies to be successively engaged by said elongated elastic element when said ring plate of one of said rotating grip assemblies is rotated in a clockwise direction and said ring plate of the other of said rotating grip assemblies is rotated in a counter-clockwise direction.

14. The exercise bar assembly of claim 8, wherein said two or more bearing posts includes a further bearing post spaced 180 degrees apart from said one bearing post around the circumference of said ring plate.

15. The exercise bar assembly of claim 8, wherein said two or more bearing posts include a spool rotatably mounted on said corresponding ring plate and said frame.

* * * * *